United States Patent [19]

Rosen

[11] Patent Number: 4,641,637

[45] Date of Patent: Feb. 10, 1987

[54] TRACTION DEVICE

[76] Inventor: Gerald M. Rosen, 2205 W. Woodbury La., Milwaukee, Wis. 53209

[21] Appl. No.: 746,872

[22] Filed: Jun. 20, 1985

Related U.S. Application Data

[63] Continuation-in-part of Ser. No. 564,483, Dec. 21, 1983, abandoned.

[51] Int. Cl.[4] ..... A61H 1/02

[52] U.S. Cl. ..... 128/75; 128/84 C

[58] Field of Search ..... 128/71, 75, 69, 70, 128/78, 84 R, 84 C; 272/120, 144, 145

[56] References Cited

U.S. PATENT DOCUMENTS

| | | | |
|---|---|---|---|
| 2,660,999 | 12/1953 | Thornton | 128/71 X |
| 2,796,061 | 6/1957 | Miller | 128/75 X |
| 2,893,384 | 7/1959 | Chick | 128/75 |
| 3,413,971 | 12/1968 | Evans | 128/75 |
| 3,572,327 | 3/1971 | Beard et al. | 128/75 |
| 4,102,336 | 7/1978 | Wiener et al. | 128/75 |
| 4,114,611 | 9/1978 | Lyle et al. | 128/75 |

FOREIGN PATENT DOCUMENTS

| | | | |
|---|---|---|---|
| 2290184 | 7/1976 | France | 128/75 |
| 978852 | 12/1982 | U.S.S.R. | 128/75 |

*Primary Examiner*—Richard J. Apley
*Assistant Examiner*—Robert W. Bahr
*Attorney, Agent, or Firm*—Harvey B. Jacobson

[57] ABSTRACT

Apparatus for use by a person lying on a support surface to enable the person to apply spinal traction to him or herself, the apparatus comprises a generally U-shaped frame with parallel side rails and a somewhat elevated crossbar connecting the side rails, a flat, seat-forming carriage mounted for back and forth adjustment along the rails, a cord grip on the crossbar, a hip-encompassing belt for a user, and a cord for extending from the base of the belt through the cord grip. With this form of the apparatus, the user places the belt around the hips, sits on the carriage, and with the knees slightly flexed engages the cord in the cord grip under minimum tension. The user then lies back, grips the carriage and exerts pressure with the feet against footrests on the crossbar so as to straighten the legs and move the carriage back along the rails thereby increasing the cord tension and applying spinal traction to the lower back.

6 Claims, 13 Drawing Figures

10
11
12
14
14a
16
16a
18
18a
20
20a
22
24
26
28
30
32
34
36
38
40
42
44
46
48
50
52
54
56
58
60
62
64
66
68
70
76
4
5

10
11
12
16
20
28
30
44
46
50
52
54
58
60
62
64
66
68
70
76

24
36
38
40
42
52

22
32
34
36

TRACTION DEVICE

This application is a continuation-in-part of application Ser. No. 564,483, filed Dec. 21, 1983, now abandoned.

BACKGROUND OF THE INVENTION

The invention relates to apparatus for use in applying spinal traction to a patient suffering from back problems and the like. It is an object of the invention to provide traction-applying apparatus of a readily portable nature which can be used on any convenient support surface. such as a bed, or on a bedroom floor, or the like.

A further object of the invention is to provide traction-applying apparatus in which the user him or herself applies the traction force.

Still another object of the invention is to apply traction-applying apparatus which includes means for applying a measured traction force.

Statement of Prior Art

The following U.S. patents relates to traction-applying apparatus. However, none of these is believed to disclose apparatus embodying the features of the present invention. The numbers are 3,556,090, 3,762,403, 3,827,429, 4,102,336, 4,114,611 and 4,282,868.

SUMMARY OF THE INVENTION

Spinal traction-applying apparatus in accordance with the invention, at least in one preferred form thereof, comprises a generally rectangular tubular frame for receipt on a support surface, such as a user's bed, the frame being of a size to accommodate a user therein, the apparatus further including an upper body receiving harness, a lower body receiving harness, upper and lower connecting means for attaching the respective harnesses to upper and lower portions of the frame, one of the connecting means comprising a cord terminating in a handgrip for user wearing the harness to apply tension on the cord acting to separate the harnesses thereby applying spinal traction to the user, said one of the connecting means further including means for releasably retaining the cord under the applied tension.

The retaining means may, for example, comprise a line tightening device attached to the relevant frame portion, and through which the cord is passed. Further, the cord may be provided with a tension scale adjacent the handgrip enabling the user to control the traction force. The frame may be adjustable for length and width to accommodate users of different build.

In another preferred form of the invention, the traction-applying apparatus may comprise a generally U-shaped frame with parallel side rails and a somewhat elevated crossbar connecting the side rails, a seat-forming carriage for back and forth movement along the rails, a cord grip on the crossbar, a hip or waist encompassing belt for a user, and a cord for extending from the base of the belt through the cord grip. With this form of the apparatus, the user places the belt around the hips, sits on the carriage and with the knees slightly bent engages the cord in the cord grip under slight tension. The user then lies back, grips the carriage, and exerts pressure with the feet against the crossbar (footrests may be provided on the crossbar for retaining the user's feet in elevated position) so as to straighten the legs and move the carriage back along the side rails thereby increasing the cord tension and applying traction to the lower back. The cord may again include a tension scale for measuring the applied traction force.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
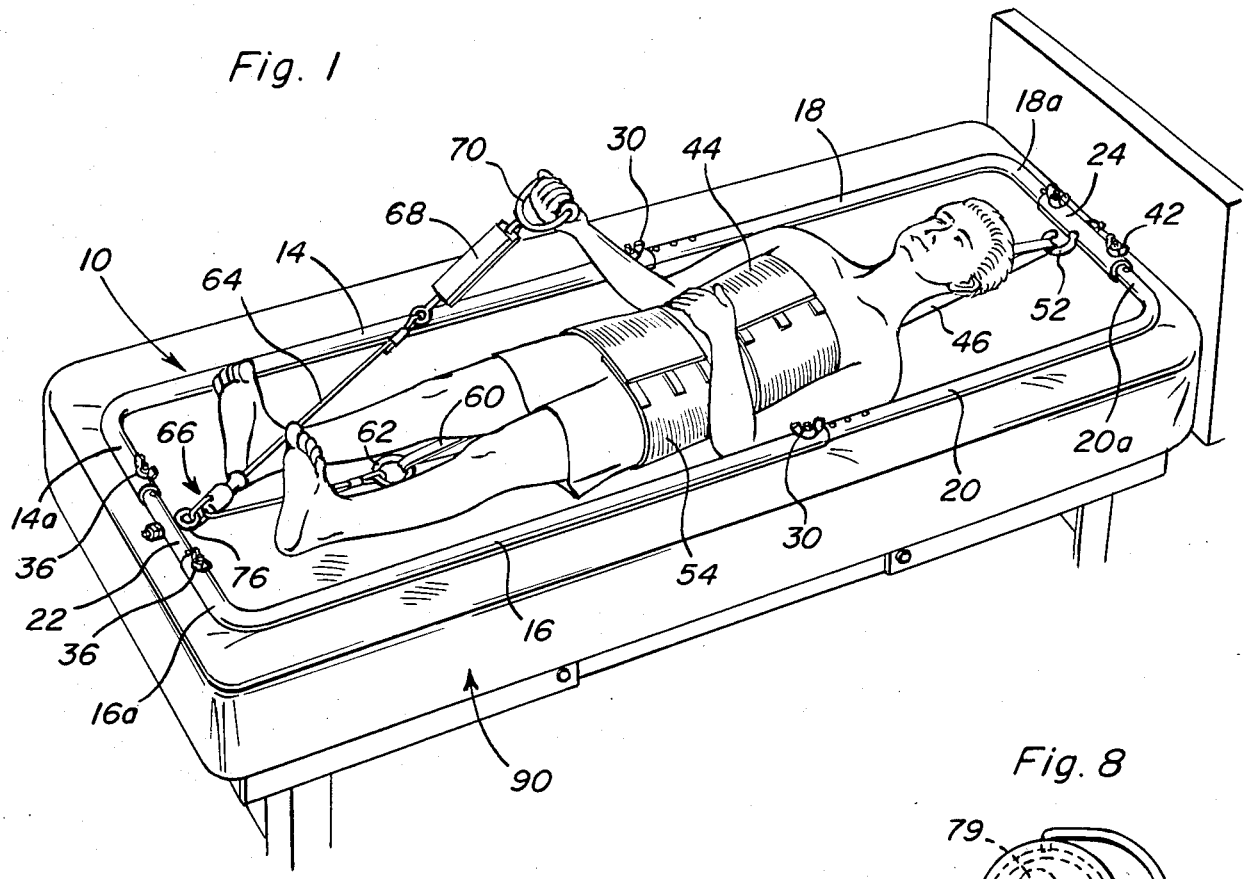
FIG. 1 is a perspective view of a first form of traction-applying apparatus in accordance with the invention shown applied to a user lying on a bed.
Figure 8:
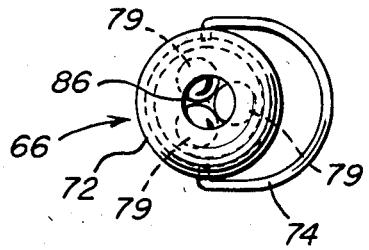
FIG. 8 is a plan view of a line tightening device shown in FIGS. 6 and 7.
Figure 6:
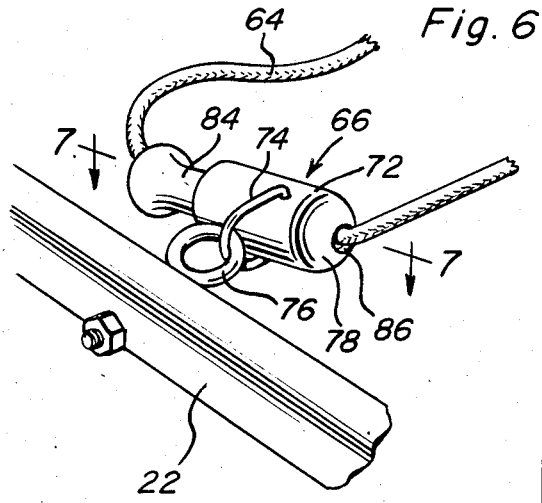
FIG. 6 is a perspective view of a part of the traction apparatus at the lower end thereof.
Figure 7:
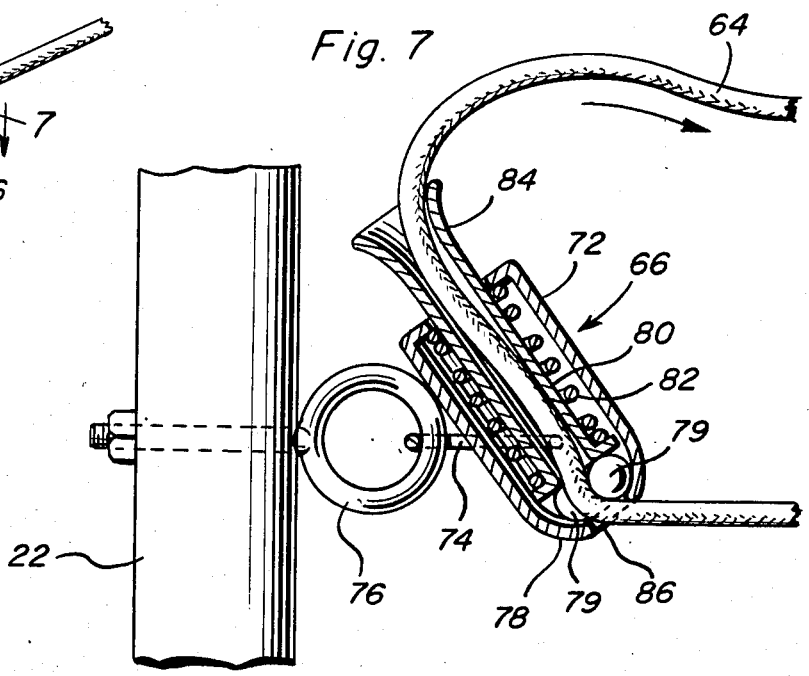
FIG. 7 is a cross sectional view to an enlarged scale on line 7—7 of FIG. 6.
Figure 2:
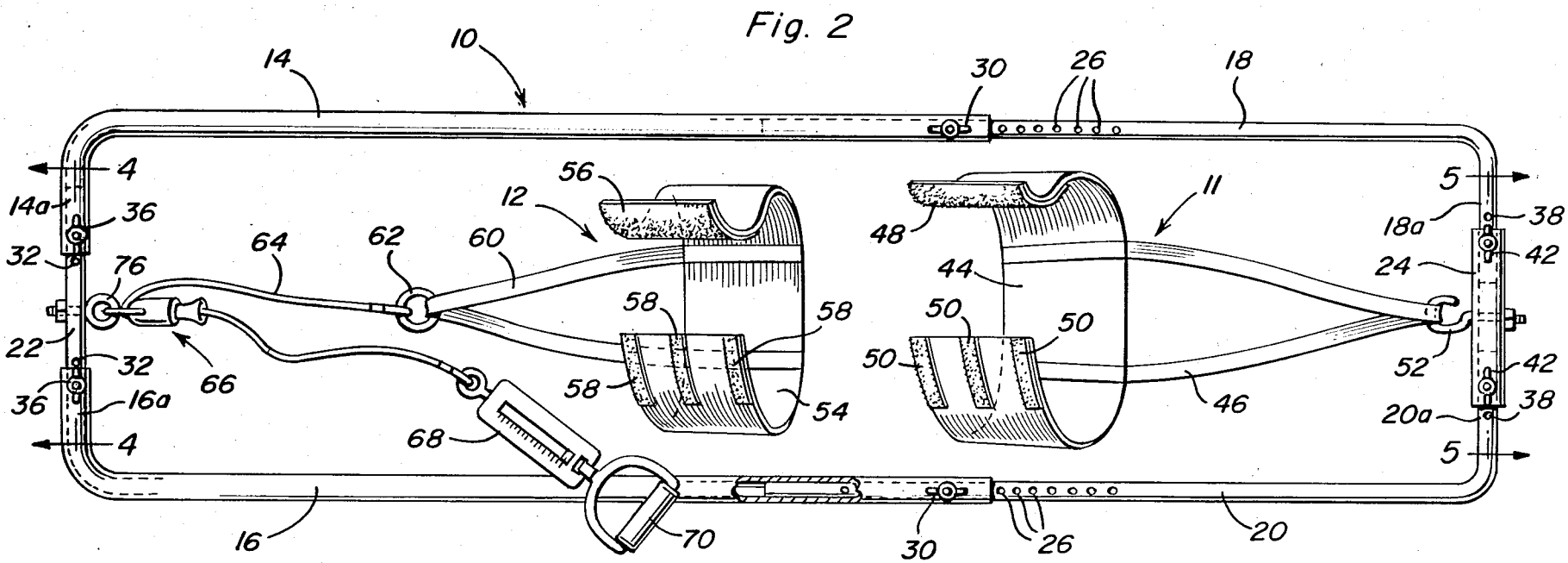
FIG. 2 is a plan view of the traction-applying apparatus.
Figure 3:
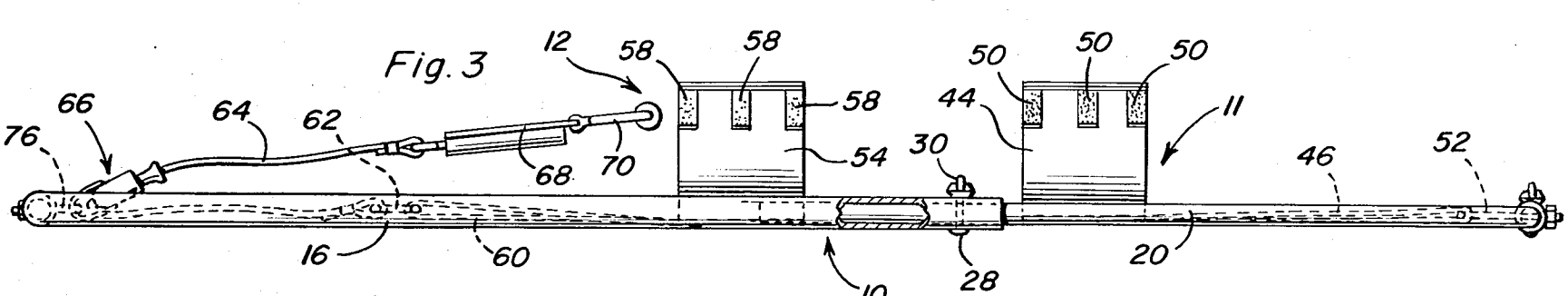
FIG. 3 is a side elevational view of the apparatus.
Figure 5:
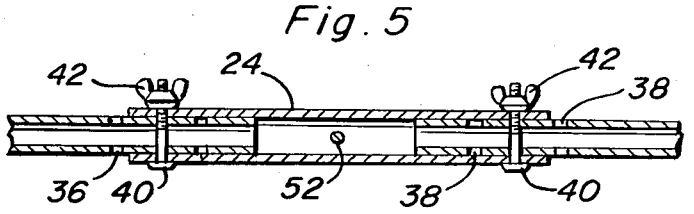
FIG. 5 is a sectional view on line 5—5 of FIG. 2.
Figure 4:
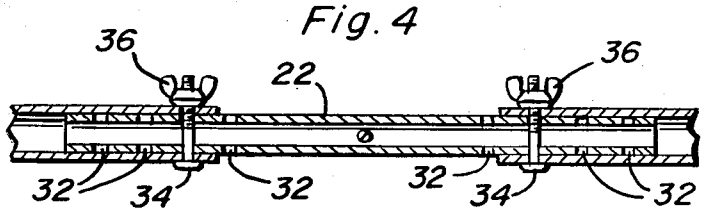
FIG. 4 is a sectional view on line 4—4 of FIG. 2.
Figure 9:
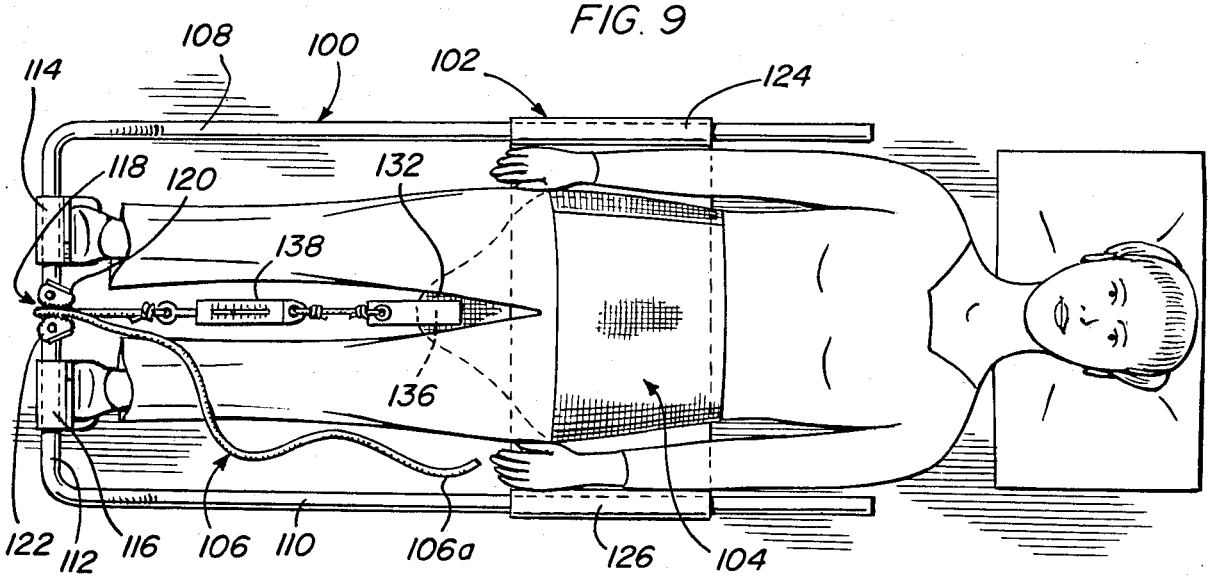
FIG. 9 is a plan view of a user on a second form of traction-applying apparatus in accordance with the invention.
Figure 10:
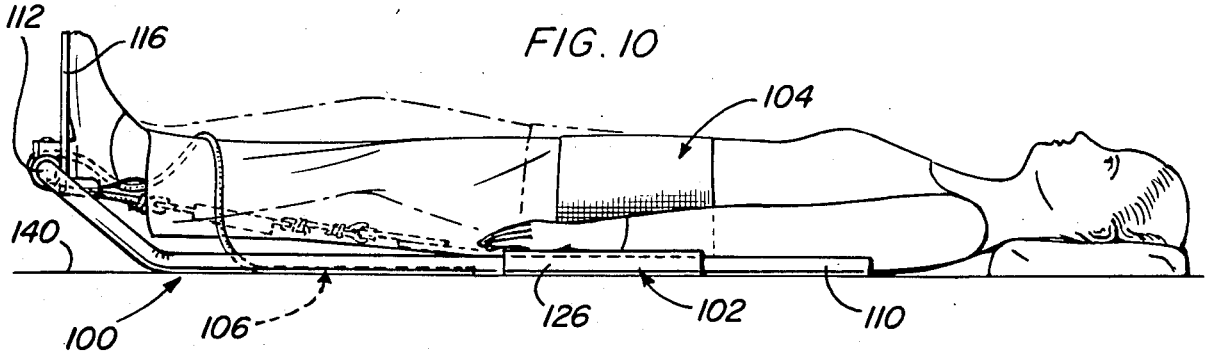
FIG. 10 is a side elevational view of the arrangement shown in FIG. 9.
Figure 11:
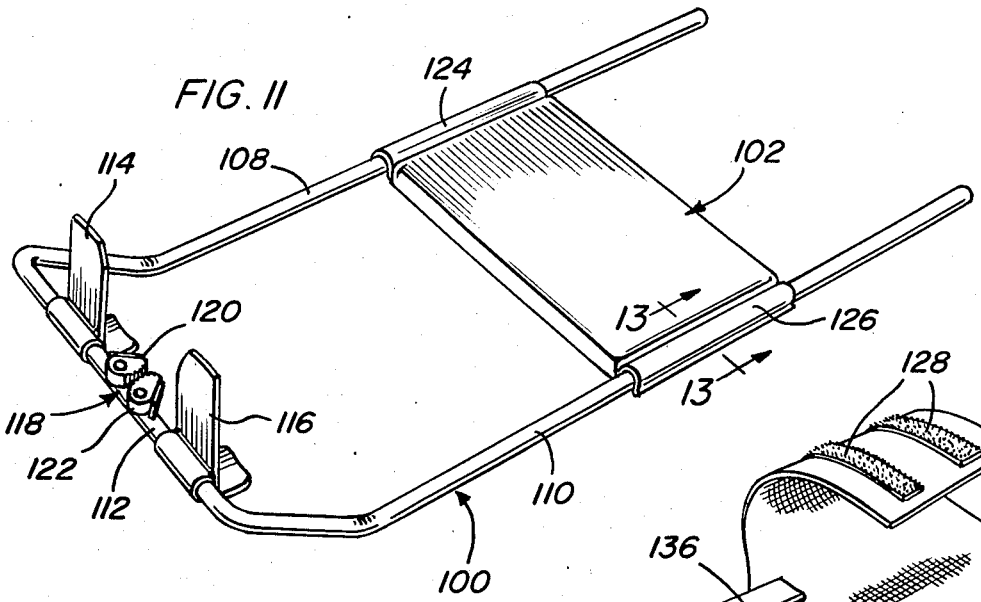
FIG. 11 is a perspective view of the second form of the apparatus.
Figure 12:
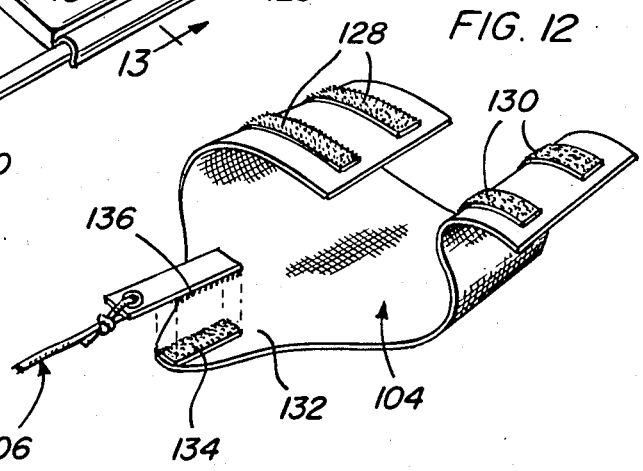
FIG. 12 is a perspective view of a hip-encompassing belt used in the second form of the apparatus.
Figure 13:
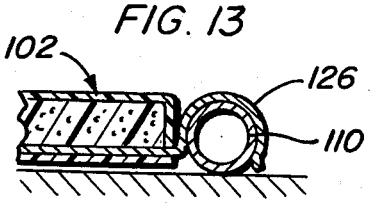
FIG. 13 is a sectional view on line 13—13 of FIG. 11.

A first form of traction-applying apparatus in accordance with the invention, and as shown in FIGS. 1–8 of the drawings, particularly FIGS. 2 and 3, comprises a generally rectangular support frame 10, an upper-body harness assembly 11 secured to one end of the frame, and a lower-body harness assembly 12 secured to the other end of the frame.

Frame 10 has elongated tubular lower side members 14, 16 and elongate upper side members 18, 20 telescopically received in members 14 and 16 with portions **14*a*, 16*a*, 18*a* and 20*a* at the ends of the side members being bent 90°. A lower end cross-piece 22 is telescopically received in the end portions 14*a* and 16*a*, and an upper tubular cross-piece 24 receives the end portions 18*a* and 20*a*. Side members 18 and 20 each have a series of openings 26 (FIG. 2) which can be selectively brought into register with retaining bolts 28 and wing nuts 30 carried at the adjacent ends of side members 14 and 16, enabling the length of the frame to be adjusted to suit a user's particular height. Similarly, cross-piece 22 has openings 32 which can be selectively brought into register with retaining bolts 34 and wing nuts 36 carried by end portions 14*a* and 16*a*, and cross-piece 24 has retaining bolts 40 and wing nuts 42 which can be selectively brought into register with openings 38 in frame portions 18*a* and 20*a***, whereby the width of the frame can be adjusted to suit the user or a support surface on which the frame is used.

Upper body harness assembly 11 comprises a chest-encompassing belt 44 and an elongate substantially inextensible strap 46 with its ends sewn onto the back of belt 44. The belt may be of a material and structure well known for use in orthopedic-type belts, and is provided with "Velcro" or like fasteners 48, 50 at its free ends allowing it to be releasably secured around a user's chest, with the fasteners accommodating size variations. Strap 46 is, in use, looped around a hook 52 secured to upper cross-piece 24 of the frame.

Lower body harness assembly 12 includes a hip-encompassing belt 54 of similar construction to belt 44, and being provided with "Velcro" fasteners 56, 58, and an elongate strap 60 with its ends sewn onto the back of the belt. Strap 60 is looped through a ring 62 to which is also attached one end of a traction-applying cord 64 of Nylon or the like. Cord 64 passes through a line-tightening device 66 and its opposite end is secured to a spring-loaded force-measuring scale 68 of known construction. A handgrip 70 is attached to the other end of the scale.

Line tightening device 66 (see FIGS. 6 to 8) has a housing 72 carrying a pivotal link 74 engaging an eye-bolt 76 secured to the lower crosspiece 22 of frame 10. The lower end 78 of housing 72 is tapered and receives three internal balls 79. Also mounted within the housing is a tubular piston member 80 surrounded by a coil spring 82 which urges the piston towards the balls. The piston has an upper bell end 84 projecting from housing 72 and cord 64 passes through an opening 86 at the bottom of housing 72, and through the interior of piston member 80. With this arrangement, when tension is applied to the cord by means of handgrip 70 (i.e. in the direction of the arrow in FIG. 7), the cord can move through the tightening device. When the tension force is released, however, spring 82 presses the base of piston member 80 against balls 79 in the tapering portion of housing 72 causing the balls to grip against the cord and prevent the cord moving back through the device in the reverse direction. To release the cord, it is necessary to pull up on the bell end of the piston member. This construction of line tightening device is generally known, and is only one form of line tightener suitable for use in the invention. Other forms of line tightener may equally well be used.

In use of the apparatus, frame 10 is adjusted to suit a user's height (preferably the frame should be about 6 inches longer than the user) and girth, and the frame (with harnesses attached) is positioned on a suitable support surface such as a bed 90 in FIG. 1. The user snugly fastens belt 44 around the chest and belt 54 around the hips. Then, while lying on the support surface, pulling up on handgrip 70 as shown in FIG. 1 causes the application of spinal traction by producing a force tending to separate the belts. The applied traction force is indicated on scale 68, so that when a required force is attained, the handgrip can be released. The action of line tightening device 66 ensures that this force is maintained by gripping the cord and preventing it from moving back through the tightening device. To release the tension in the cord, the bell end 84 of piston member 80 may be pulled up, as previously described, or alternatively the user may release belt 54.

It will be appreciated from the foregoing that the form of the invention shown in FIGS. 1–8 provides a convenient form of spinal traction-applying apparatus which enables a user him or herself to apply a measured amount of traction. While it is preferred that the apparatus includes a support frame 10 of the type described, the upper and lower harnesses could be used with different support means of sufficient longitudinal rigidity. For example, it may be possible to secure the harnesses directly to a bed frame or the like.

FIGS. 9–13 show a second form of traction-applying apparatus in accordance with the invention, and which comprises generally a U-shaped frame 100, a seat-forming flat carriage 102, a hip-encompassing belt 104 for a user, and a traction cord 106.

Frame 100 may be of tubular metal with elongate side rails 108, 110 bent upwardly at their forward ends to provide a somewhat elevated crossbar 112. A pair of pivotal footrests 114, 116 may be provided on the crossbar, along with a central cord grip 118 of known form comprising a pair of pivotal serrated gripping jaws 120, 122. Preferably the footrests are designed to retain the user's feet in elevated position, with the heels being about 9 inches off surface 140 on which the frame is supported. Carriage 102 may be of any suitable construction for supporting the weight of a user and may have concave runners 124, 126 for engaging the respective side rails 108, 110 of the frame 100 in a manner enabling the carriage to slide along the rails. Other suitable slide means may be provided, such as rail-engaging rollers on the carriage.

Hip belt 104 may be of similar form to belt 54 of the previous embodiment with size-adjusting Velcro or like fasteners 128, 130. The belt may have a tail portion 132 with a further Velcro or like fastener 134 for releasably attaching a complementary fastener 136 at one end of cord 106. As in the previous embodiment, the cord may be provided with a tension scale 138.

In use, with belt 104 in place, a user sits on carriage 102 with the feet on footrest 114, 116 and the knees flexed, having adjusted the position of the carriage along the side rail to suit the user's height cord 106 passed under crossbar 112 and through cord grip 118. The user pulls on free end **106*a* of the cord until it is under slight tension. When the cord is released, it is held by the cord grip. Then, the user lies back, may grip the forward edge of carriage 102 and straightens the knees (see FIG. 10) thereby increasing the tension in cord 102 which remains clamped in the cord grip and applying spinal traction by creating downward tension on the hips, with the footrest constituting a means for providing a reaction force on frame 100** against which the traction force is applied.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Spinal traction-applying apparatus for use on a support surface comprising a frame with parallel elongate side rails and a crossbar connecting the side rails, a seat-forming carriage for back and forth adjustment along the side rails toward and away from the crossbar, a cord grip on the crossbar, a lower body encompassing belt for a user, and a cord for extending from the belt through the cord grip so that a free end thereof may be grasped by the user wearing the belt and seated on the carriage with the user's feet on the crossbar, the cord grip having releasable gripping means for releasing the cord when the user pulls on the free end of the cord with the knees flexed to allow the user to apply minimum tension to the cord and for gripping the cord when the user lies back on the carriage and straightens the knees thereby increasing the tension in the cord and applying spinal traction to the user.

2. The invention of claim 1 wherein the crossbar is somewhat elevated from the rails and include footrests on opposite sides of the cord grip for retaining the user's feet in elevated position off the support surface.

3. The invention of claim 2 wherein the footrests retain the user's heels about 9 inches off the support surface.

4. The invention of claim 1 including a spring tension measuring scale associated with the cord.

5. The invention of claim 1 including loop-pile type fastener means between the cord and the belt.

6. The invention of claim 1 wherein the gripping means comprises pivotal serrated gripping jaws on the crossbar.

* * * * *